US005671844A

United States Patent [19]

Sircy

[11] Patent Number: 5,671,844

[45] Date of Patent: Sep. 30, 1997

[54] STORAGE DEVICE FOR STORING SPORTS EQUIPMENT

[76] Inventor: Mark L. Sircy, 575 Anchor Dr., Lenoir City, Tenn. 37771

[21] Appl. No.: 642,509

[22] Filed: May 3, 1996

[51] Int. Cl.[6] ..... B65D 85/20

[52] U.S. Cl. ..... 206/315.1; 220/311.2; 220/475

[58] Field of Search ..... 206/315.1, 315.9; 220/475, 212, 735, 729; 248/311.2, 218.4, 230.1; 215/228, 390, 386

[56] References Cited

U.S. PATENT DOCUMENTS

| | | | |
|---|---|---|---|
| 1,607,863 | 11/1926 | Betts | 220/735 |
| 2,017,245 | 10/1935 | Hertzberg | 220/475 |
| 3,666,223 | 5/1972 | Moore | 248/311.2 |
| 3,722,779 | 3/1973 | Chang | 220/735 |
| 3,990,654 | 11/1976 | Michael | 248/311.2 |
| 4,312,465 | 1/1982 | Sinkhorn et al. | 220/475 |
| 4,420,681 | 12/1983 | Arnold | 206/315.9 |
| 4,860,909 | 8/1989 | Leumi | 220/475 |
| 4,934,644 | 6/1990 | Nagy et al. | 248/218.4 |
| 5,067,626 | 11/1991 | Leumi | 220/475 |
| 5,154,386 | 10/1992 | Heck | 248/218.4 |
| 5,216,902 | 6/1993 | Sagi | 70/39 |
| 5,405,113 | 4/1995 | Jaw | 248/230.1 |
| 5,472,157 | 12/1995 | Lehrman | 248/311.2 |

FOREIGN PATENT DOCUMENTS

| | | | |
|---|---|---|---|
| 478091 | 10/1951 | Canada | 220/475 |

*Primary Examiner*—Paul T. Sewell
*Assistant Examiner*—Nhan T. Lam
*Attorney, Agent, or Firm*—Michael E. McKee

[57] ABSTRACT

A storage device for storing sports equipment is adapted for securement to a substantially vertical surface of an object situated adjacent the site of a playing court or field. The device includes an open-topped receptacle for holding the sports equipment desired to be stored and a lid hingedly attached to the receptacle for opening and closing the top thereof. In one embodiment of the invention, the device is securable to a post upon which a basketball goal is mounted, and the receptacle thereof is sized to hold a basketball positioned therein.

18 Claims, 3 Drawing Sheets

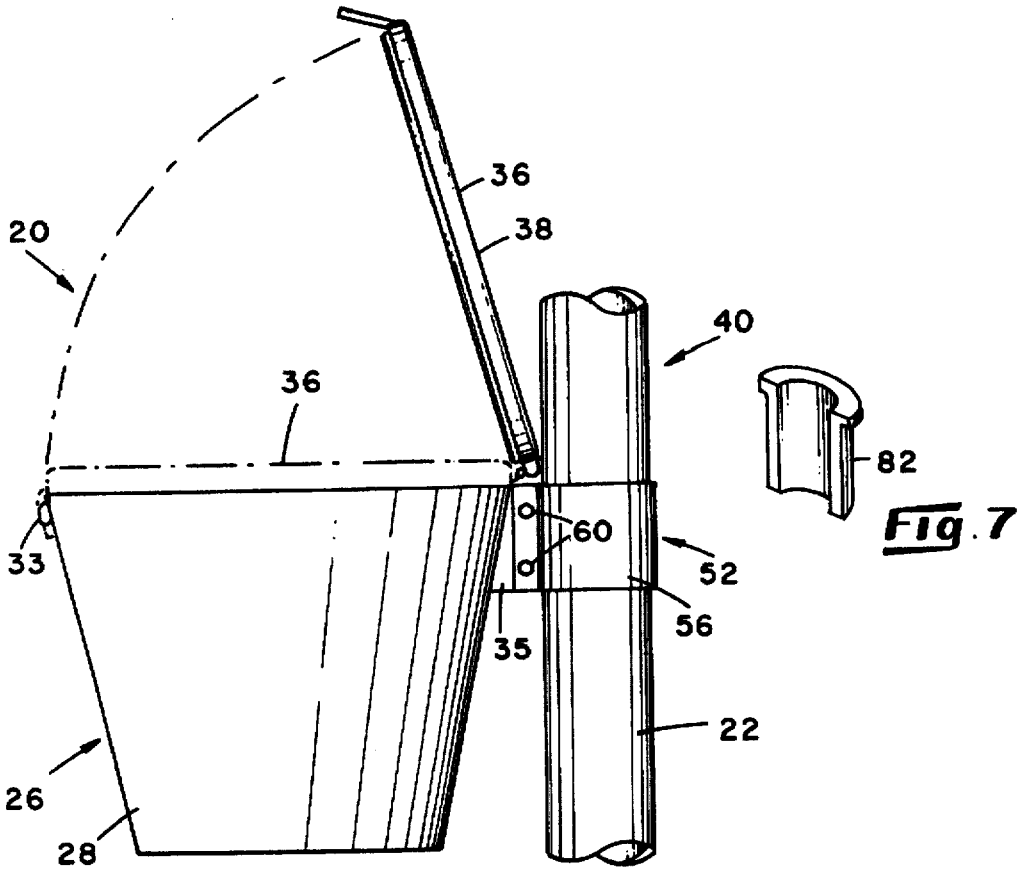
Fig. 7
Fig. 6
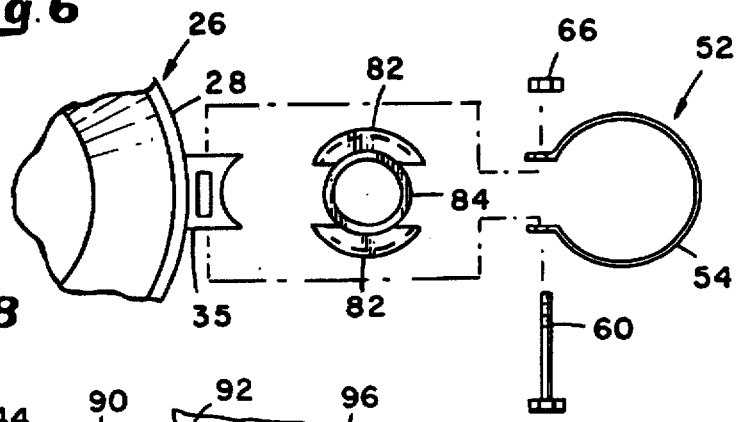
Fig. 8
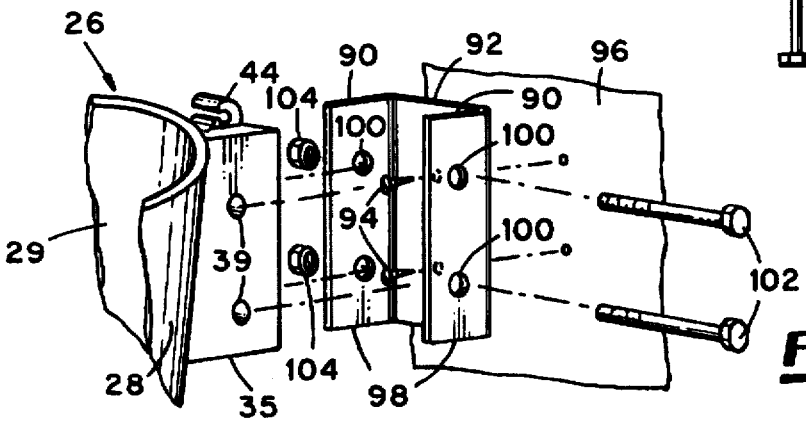
Fig. 9

STORAGE DEVICE FOR STORING SPORTS EQUIPMENT

BACKGROUND OF THE INVENTION

This invention relates generally to sports accessories and relates, more particularly, to such an accessory which can be utilized for storing sports equipment until needed.

Some sporting games, such as basketball and football, commonly require a relatively spacious playing court with goals or a field. However, to play such sports, additional accessories, such as a ball, are commonly needed. It would be desirable to provide a storage device for mounting at the site of the playing court or field for holding needed accessories, such as a ball, so that when players arrive at the court or field, the needed equipment is available at the site of competition.

Accordingly, it is an object of the present invention to provide a new and improved storage device for storing sports equipment adjacent the site of a playing court or field.

Another object of the present invention is to provide such a device which is durable and weather-resistant to accommodate its use in an outdoor environment.

Still another object of the present invention is to provide such a device which is particularly well-suited for mounting to the post upon which a basketball goal is mounted or to a wall adjacent a basketball goal.

Yet another object of the present invention is to provide such a device which is uncomplicated in construction and effective in operation.

SUMMARY OF THE INVENTION

This invention resides in a storage device for sports equipment wherein the device is attachable to an object situated adjacent the site of a playing court or field and wherein the object is provided with a substantially vertical surface.

The storage device includes means defining an open-topped receptacle for holding the sports equipment desired to be stored, and the receptacle includes an interior which is sized to accept the sports equipment desired to be stored. A lid is provided for the open top of the receptacle of the receptacle-defining means wherein the lid is hingedly attached to the receptacle-defining means for movement between opened and closed conditions. The storage device also includes means associated with the receptacle-defining means for attaching the receptacle-defining means in a stationary position against the substantially vertical surface of an object situated adjacent the site of a playing court or field. Therefore, by storing the sports equipment within the storage device, the equipment is readily available for use at the site of a playing court or field.

BRIEF DESCRIPTION OF THE DRAWINGS

FIG. 6 is a side elevational view of the FIG. 1 device.

FIG. 7 is a perspective view of an optional spacer member for use with the FIG. 1 device.

FIG. 8 is a fragmentary view similar to that of FIG. 3 illustrating the use of the FIG. 1 device in conjunction with a goal-supporting post of alternative diameter.

FIG. 9 is a fragmentary perspective view of an alternative storage device employing means for securing the device to a flat vertical surface.

DETAILED DESCRIPTION OF THE ILLUSTRATED EMBODIMENTS

Figure 1:
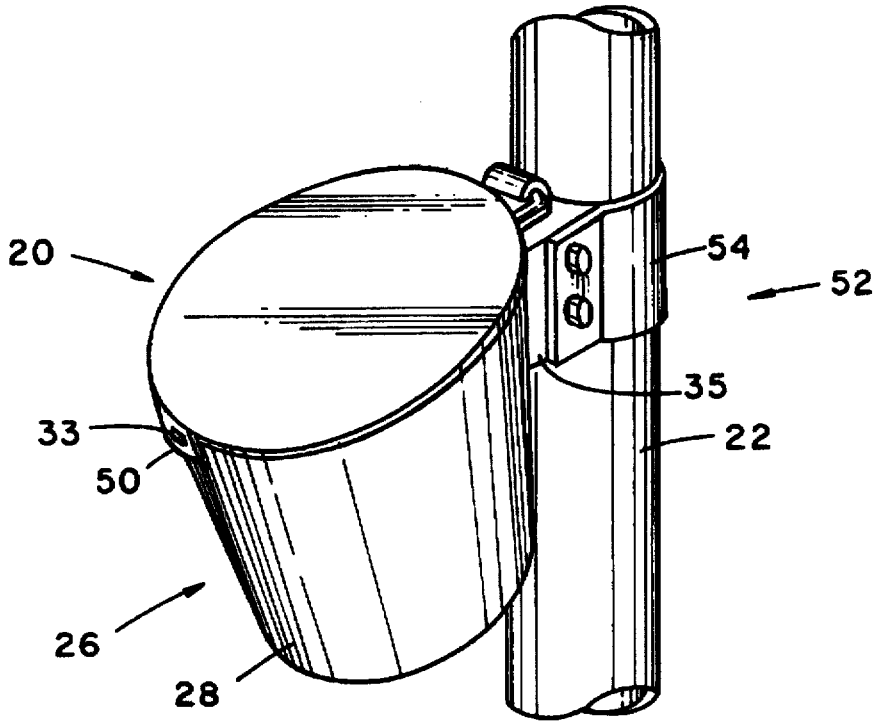
FIG. 1 is a perspective view of a storage device shown operatively attached to a post upon which a basketball goal is mounted.

Turning now to the drawings in greater detail, there is shown in FIG. 1 an embodiment, generally indicated 20, of a storage device within which features of the present invention are embodied. The depicted device 20 is shown attached to a vertically-supported post 22 upon which a basketball goal and backboard (not shown) are mounted and is adapted to store a basketball 21 (FIG. 2) between games played at the goal. Thus, the device 20 provides a convenient means for storing a basketball at the site of the goal until the ball is removed for play and a convenient storage means to which the basketball can be returned following play.

Figure 2:
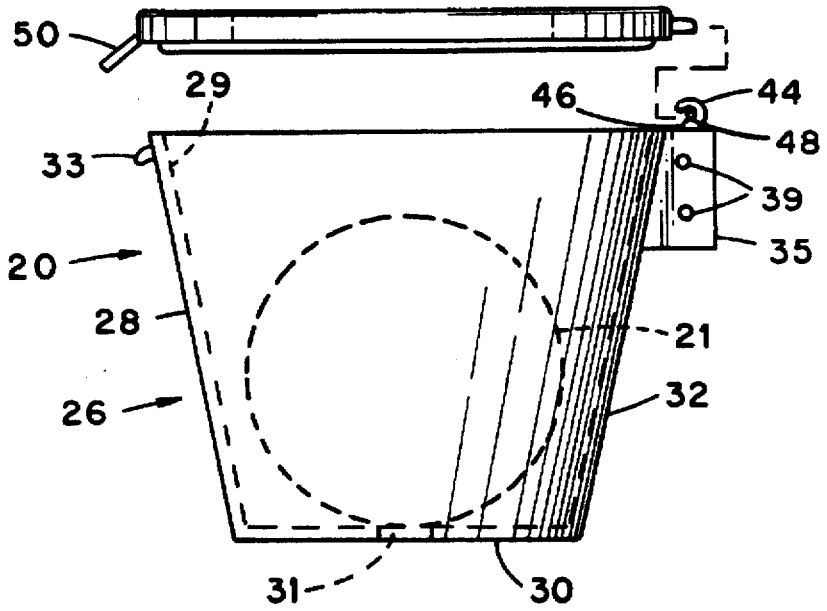
FIG. 2 is a side elevational view of selected components of the FIG. 1 device.
Figure 3:
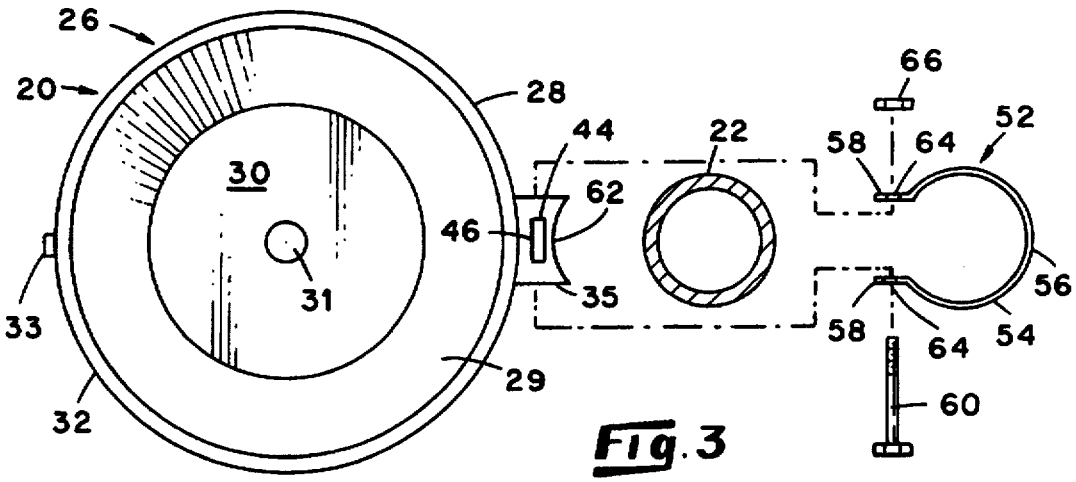
FIG. 3 is a cross sectional view of the FIG. 1 device taken about on line 3—3 of FIG. 1 but shown with the lid of the device removed from the remainder thereof.

With reference to FIGS. 1–3, the device 20 includes means, generally indicated 26, defining an open-topped receptacle 28 which is sized to hold sports equipment, such as the basketball 21, intended to be stored therein. The depicted receptacle 28 has a bottom 30 and sidewalls 32 which are joined together and shaped to provide the receptacle 28 with somewhat of a frusto-conical appearance. The bottom 30 and sidewalls 32 have interior surfaces which collectively provide the interior, indicated 29, of the receptacle 28 within which the sports equipment can be stored, and the bottom 30 defines a through-opening 31 therein which permits the passage of water therethrough.

Integrally attached to the front of the receptacle 28 (or on the right side as viewed in FIG. 2) is a tab 33 whose purpose will be apparent herein, and integrally attached to the back of the receptacle 28 (or on the left side as viewed in FIG. 2) is a body portion 35 having a pair of through-openings 39 whose purpose will also become apparent herein.

Figure 4:
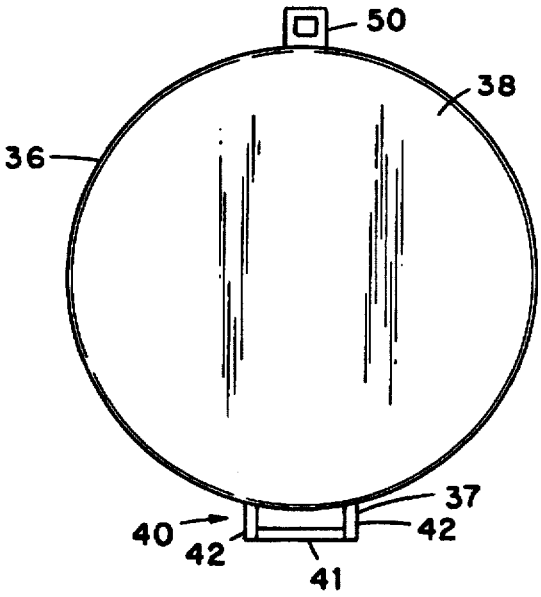
FIG. 4 is a top plan view of the lid of the FIG. 1 device.
Figure 5:
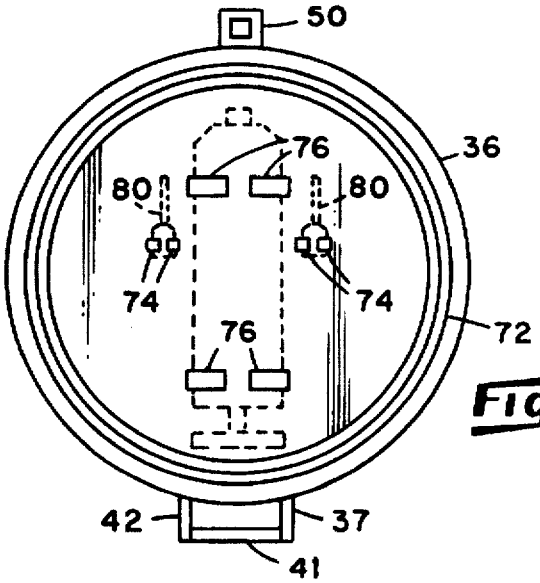
FIG. 5 is a bottom plan view of the lid of the FIG. 1 device.

The device 20 also includes a lid 36 (best shown in FIGS. 4 and 5) for the top of the receptacle 28 enabling the top of the receptacle 28 to be selectively opened or closed and means, generally indicated 40, for hingedly securing the lid 36 to the receptacle-defining means 24. To this end, a major portion, indicated 38, of the lid 36 is platen-like in shape so as to completely cover, when desired, the open top of the receptacle 28 and also includes a hinge member 37 integrally joined to the major portion 38 of the lid 36. In the depicted device 20, the hinge member 37 includes a linear rod-like section 41 which is attached to the major portion 38 of the lid 36 with a pair of post sections 42, and the rod-like section 41 is adapted to interfit with the receptacle-defining means 26 in a snap-fit relationship.

In this connection and with reference to FIGS. 2 and 3, the aforementioned body portion 35 of the receptacle-defining means 26 includes a boss portion 44 which protrudes generally upwardly therefrom, and the boss portion 44 includes a forward surface 46 within which is defined a groove-like recess 48 which opens generally forwardly of the receptacle 28 (i.e. toward the left as viewed in FIG. 2). The recess 48 is sized so that by urging the rod-like section 41 of the lid 34 sideways into the recess 48, the section 41 is snugly received by the recess 48 in a snap-fit relationship. In addition, the engaging surfaces of the rod-like section 41 and the recess 48 are relatively smooth so that the rod-like section 40 can be rotated within the recess 48 about the longitudinal axis of the rod-like section 41 between two angular positions. Thus, the cooperation between the rod-like section 41 and the recess 48 of the boss portion 44 enable the lid 34 to be hingedly moved relative to the receptacle 28 between an open position (as illustrated in solid lines in FIG. 6) and a closed position (as illustrated in phantom in FIG. 6) as the lid 34 is rotated, i.e. pivoted, about the rod-like section 41 as aforedescribed.

Associated with the forward edge of the lid 34 (or along the left edge of the lid as viewed in FIG. 2) is provided a tab section 50 which cooperates with the tab 33 of the receptacle 28 for releasably locking the lid 34 in a closed position upon the receptacle 28. To this end, the tab section 50 includes a relatively square opening for accepting the tab 33 when the lid 34 is positioned in its closed (FIG. 6 phantom-line position) and the tab section 50 is positioned over the tab 33. The lid 34 is thereafter prevented from being lifted to its open (FIG. 6 solid-line position) by the tab 33 unless (and until) the tab section 50 is manually lifted off of the tab 33.

With reference again to FIG. 5, the major portion 38 of the lid 34 also includes a downwardly-directed rim 72 adapted to interfit within the mouth of the receptacle top when the lid 34 is positioned thereon and also includes downwardly-extending sets of tabs 74, 76 adapted to hold a hand pump 78 and inflation needles 80 until needed. In this connection, the tabs 74 of one set of tabs are adapted to hold the body of a needle 80 in snap-fit relationship when inserted therebetween, and the tabs 76 of the other set of tabs are adapted to hold the body of a hand pump 78 in snap-fit relationship when inserted therebetween. By sizing the rim 72 so that it fits snugly within the mouth of the receptacle top when the lid 34 is positioned in the closed position, the mouth of the receptacle 34 is sealed against the ingress of moisture so that the receptacle/lid arrangement is rendered weatherproof.

Each of the receptacle-defining means 26 and the lid 34 is constructed of a relatively hard plastic, but any of a number of suitable materials can be used to construct the receptacle-defining means 26 and the lid 34.

Also associated with the attachment means are means, generally indicated 52 in FIG. 1 and 3, for clamping the receptacle-defining means 26 to the post 22. In the depicted embodiment 20, such clamping means 52 includes a clamp 54 connected to the body portion 35 and positioned about the post 22 for securing the receptacle-defining means 26 to the post 22. As best shown in FIG. 3, the clamp 54 is somewhat rounded in cross section having a base portion 56 which is shaped in general conformity to the (cylindrical) outer surface of the post 22 and two leg portions 58 which are attached to the base portion 58. As will be apparent herein, each of the leg portions 58 includes two sets of aligned openings 64 for receiving the shanks of bolts 60 for securing the receptacle 28 to the post 22 by way of the through-openings 39.

When positioning the receptacle-defining means 26 against the post 22 for securement thereto with the clamp 54, the body portion 35 is positioned in abutting relationship with the surface of the post 22. To enhance the stability of the body portion 35 when positioned against the post 22, the rearward surface, indicated 62 in FIG. 3, of the body portion 35 is arcuate (i.e. concave) in shape to conform generally to the shape of the rounded curvature of the surface of the post 22. Therefore, when positioned against the post 22, the rearward surface 62 engages the surface of the post 22 over a relatively broad area.

With the receptacle-defining means 26 positioned adjacent the post 22 so that the arcuate surface 62 of the body portion 35 is positioned in abutting relationship with the curved surface of the post 22, the clamp 54 is positioned about the post 22 and arranged so that its leg portions 58 are disposed on opposite sides of the body portion 35. The clamp 54 is then manipulated so that its openings 64 are aligned with the openings 39 provided in the body portion 35, and then the bolts 60 are inserted into and secured within the aligned openings with nuts 66.

The capacity of the device 20 to be secured to the post 22 can be appreciated when considering the fact that at numerous outdoor basketball courts at which a basketball goal is commonly mounted upon a post (like that of the depicted vertical post 22), no basketball is readily available. By securing the receptacle 28 to the post 22, the receptacle 28 provides a means for storing a basketball and related equipment, such as inflation needles 60 (FIG. 5) and a hand pump 78, which is convenient to the site of the basketball court.

As far as exemplary dimensions of the device 20 are concerned, it has been found that a receptacle 28 having an interior having a bottom which measures about 9.0 inches in diameter and having a top which measures about 13.0 inches in diameter is well-suited for storing a basketball having a diameter of about 10.0 inches.

It will be understood that numerous modifications and substitutions can be had to the aforedescribed embodiments without departing from the spirit of the invention. For example, although the aforedescribed clamp 54 of the clamping means 52 has been shown and described as being sized to fit snugly about the post 22 when positioned thereabout, a pair of optional spacers, like the spacer 82 shown in FIG. 7, can be utilized to facilitate the securement of the clamping means 52 about a post having a significantly smaller diameter than that of the post 22 of FIGS. 1, 3 and 6. For example, there is shown in FIG. 8 a post 84 about which the clamping means 52 is secured and a pair of spacers 82 which have been sandwiched between the interior of the clamp 54 and the outer surface of the post 84. It follows that during use, the spacers 82 fill the space between the clamp 54 and the post 84.

In addition, although the aforedescribed clamping means 52 has been shown and described as including a clamp 54 for securement about a substantially circular post 22 or 84, clamping means in accordance with the broader aspects of the invention may include a bracket adapted to hold the receptacle 28 against a flat, vertical wall. For example, there is shown in FIG. 9, a bracket 90 which is substantially U-shaped in cross section having a base portion 92 which is securable against a flat, vertical wall 96 with screws 94 and leg portions 98 for joining the base portion 92 to the body portion 35. In this connection, the leg portions 92 include openings 100 which are alignable with the through-openings 39 of the body portion 35 for securement thereto with bolts 102 and nuts 104.

Accordingly, the aforedescribed embodiment is intended for the purpose of illustration and not as limitation.

I claim:

1. A storage device for sports equipment wherein the device is attachable to an object situated adjacent the site of a playing court or field and wherein the object is provided with a substantially vertical surface, the storage device comprising:

means defining an open-topped receptacle for holding the sports equipment desired to be stored, the receptacle having an interior which is sized to accept the sports equipment desired to be stored;

a lid for the open top of the receptacle of the receptacle-defining means wherein the lid is hingedly attached to the receptacle-defining means for movement between opened and closed conditions;

means associated with the receptacle-defining means for attaching the receptacle-defining means in a stationary position against the substantially vertical surface of an object situated adjacent the site of a playing court or field, and wherein the lid has an underside and includes means associated with the underside for releasably securing a hand pump adjacent the underside of the lid.

2. The device as defined in claim 1 wherein the open-topped receptacle is substantially frusto-conical in shape.

3. The device as defined in claim 1 wherein the lid cooperates with the receptacle of the receptacle-defining means so that when in closed position, the lid seals the receptacle and helps to render the receptacle weather-proof.

4. The device as defined in claim 1 wherein the receptacle-defining means includes a body portion which protrudes from one side of the remainder of the receptacle-defining means and has a surface which is positionable adjacent the vertical surface which the device is attached thereto.

5. The device as defined in claim 4 wherein the vertical surface of the object to which the receptacle is attachable has one shape as a path is traced substantially horizontally thereacross, and the body portion has one surface which is generally complimentary to said one shape of the vertical surface of the object so that when the receptacle-defining means is operatively attached to the object, a substantial portion of said one surface of the body is in contact with the vertical surface of the object.

6. The device as defined in claim 5 wherein said one shape of the vertical surface is curved as a path is traced generally horizontally thereacross, and the one surface of the body portion is curved in shape.

7. The device as defined in claim 4 wherein the associated means includes clamping means which cooperates with the vertical surface and the body portion for attaching the receptacle-defining means to the vertical surface as aforesaid.

8. The device as defined in claim 7 wherein the vertical surface to which the device is attachable is provided by the surface of a vertically-oriented post, and the clamping means includes a clamp positionable about the post for securely holding the body portion of the receptacle-defining means against the post.

9. The device as defined in claim 7 wherein the vertical surface to which the device is attachable is provided by the surface of a vertically-oriented wall, and the clamping means includes a bracket which is securable between the wall and the body portion for attaching the receptacle-defining means to the wall.

10. A storage device for sports equipment wherein the device is attachable to a substantially vertical surface of an object situated adjacent the site of a playing court or field, the storage device comprising:

means defining an open-topped receptacle for holding the sports equipment desired to be stored, the receptacle having an interior which is sized to accept the sports equipment desired to be stored;

a lid for the open top of the receptacle of the receptacle-defining means;

means for hingedly securing the lid to the receptacle-defining means for permitting the lid to be pivotally moved relative to the receptacle-defining means between an opened and a closed position;

means associated with the receptacle-defining means for attaching the receptacle-defining means in a stationary position against the substantially vertical surface of an object situated adjacent the site of a playing court or field, and wherein the lid has an underside and includes means associated with the underside for releasably securing a hand pump adjacent the underside of the lid.

11. The device as defined in claim 10 wherein the open-topped receptacle is substantially frusto-conical in shape.

12. The device as defined in claim 10 wherein the lid cooperates with the receptacle of the receptacle-defining means so that when in closed position, the lid seals the receptacle and helps to render the receptacle weather-proof.

13. The device as defined in claim 10 wherein the receptacle-defining means includes a body portion which protrudes from one side of the remainder of the receptacle-defining means and has a surface which is positionable adjacent the vertical surface which the device is attached thereto.

14. The device as defined in claim 13 wherein the vertical surface of the object to which the receptacle is attachable has one shape as a path is traced substantially horizontally thereacross, and the body portion has one surface which is shaped generally complimentary to said one shape of the vertical surface of the object so that when the receptacle-defining means is attached to the object, a substantial portion of said one surface of the body is in contact with the vertical surface of the object.

15. The device as defined in claim 14 wherein said one shape of the vertical surface is curved as a path is traced generally horizontally thereacross, and the one surface of the body portion is curved in shape.

16. The device as defined in claim 13 wherein the associated means includes clamping means which cooperates with the vertical surface and the body portion for attaching the receptacle-defining means to the vertical surface as aforesaid.

17. The device as defined in claim 16 wherein the vertical surface to which the device is attachable is provided by the surface of a vertically-oriented post, and the clamping means includes a clamp positionable about the post for securely holding the body portion of the receptacle-defining means against the post.

18. The device as defined in claim 16 wherein the vertical surface to which the device is attachable is provided by the surface of a vertically-oriented wall, and the clamping means includes a bracket which is securable between the wall and the body portion for attaching the receptacle-defining means to the wall.

* * * * *